United States Patent [19]

Pozzobon

[11] Patent Number: 4,773,786

[45] Date of Patent: Sep. 27, 1988

[54] BOARD FOR WRITING WITH PEN PRODUCING ERASABLE MARKING, THE BOARD HAVING A HEADER IN THE UPPER PART, HOOKED TO THE BOARD BY MEANS OF A SPECIAL ATTACHMENT

[75] Inventor: Eugenio Pozzobon, Padua, Italy

[73] Assignee: Pubblidono S.R.L., Padua, Italy

[21] Appl. No.: 12,331

[22] Filed: Feb. 9, 1987

[30] Foreign Application Priority Data

Feb. 11, 1986 [IT] Italy ..... 64,222/86[U]

[51] Int. Cl.[4] ..... B42F 13/02; B42F 1/00; B42D 5/00; B42D 17/00

[52] U.S. Cl. ..... 402/21; 281/39; 281/50; 24/67.11

[58] Field of Search ..... 402/21, 24, 25, 36, 402/50, 80 R; 281/26, 28, 35, 39, 50, 44; 24/67.11, 153, 154; 312/184

[56] References Cited

U.S. PATENT DOCUMENTS

| | | | |
|---|---|---|---|
| 2,879,609 | 3/1959 | Watkins | 281/39 |
| 3,524,225 | 8/1970 | Trikilis | 281/50 |

FOREIGN PATENT DOCUMENTS

| | | | |
|---|---|---|---|
| 222620 | 1/1962 | Austria | 24/67.11 |
| 907571 | 4/1902 | France | 24/67.11 |
| 8402406 | 3/1986 | Netherlands | 402/21 |
| 149455 | 3/1955 | Sweden | 281/44 |
| 2043535 | 10/1980 | United Kingdom | 281/26 |

*Primary Examiner*—E. R. Kazenske
*Assistant Examiner*—Paul M. Heyrana, Sr.
*Attorney, Agent, or Firm*—Bucknam and Archer

[57] ABSTRACT

A board for writing by means of a pen producing erasable marking comprises a header (2) fixed to it by means of a hooking device which permits the header to be removed from the board and hooked again an infinite number of times without damaging any part of the header or the board. The hooking device consists of wings (7) which act as a guide when the board and the header are assembled, a pair of elements (8) of inverted "U" shape which are inserted into a pair of openings (6) located in the board.

1 Claim, 3 Drawing Sheets

BOARD FOR WRITING WITH PEN PRODUCING ERASABLE MARKING, THE BOARD HAVING A HEADER IN THE UPPER PART, HOOKED TO THE BOARD BY MEANS OF A SPECIAL ATTACHMENT

The present invention relates to a board of the type commonly used by writing by means of a pen which gives erasable markings and the board has in the top part, a header fastened to the board by means of a particular hooking device.

Several boards of square or rectangular shape have been known, made, in general, of cardboard or suitable plastic material, coated, corresponding to one surface by a suitable film, which surface may serve as a writing surface for particular pens, the markings of which may be easily erased by means of a cloth or similar material. In this manner, the surface may be used for writing an infinite number of times. Boards are known which have in the top part, a header within which the upper end of the board is inserted and hooked.

These boards are generally sold at retail but more frequently they are distributed as a promotional item by companies to their suppliers, clients and representatives and in this case they have written the name of the company and/or the mark, and/or other advertising material which refers to the firm which gives these boards as a gift. In addition, on the header there is a recess within which the pen used for writing on the board is located.

The object of the present invention is to provide a board equipped with a novel hooking device which permits the fastening of the header to the board. In particular, by means of the device of the present invention, the hooking may be carried out in a reversible manner, that is the header may be removed and hooked again to the board an infinite number of times without the danger of damaging in an irreversible way the delicate hooking devices presently used on the boards after two or three hooking operations. In the devices known in the art, the hooking between the two above-mentioned elements consists of a pair of wings located on the rear surface of the header, made of plastic material, in places corresponding to the lateral borders of the same. The free end of the wings must be partially inserted within a pair of slits made in the board. Clearly, in order to disassemble the header from the board, it is necessary to bend slightly these wings, when then have a tendency to break in the area corresponding to the area where the wings are attached to the rear surface of the header.

In contrast, in the device according to the present invention, on the rear surface of the header, two elements profiled in the shape of a "U" are located, and during the operation of hooking, they slightly bend the board and then are inserted within two openings in the central portion of the same board. In this manner, the header is not subjected in any part to a bending force during the hooking operation. In this manner, it may be removed and hooked again to the board an infinite number of times. The structural features mentioned hereinabove as well as others will be illustrated hereinbelow referring to the drawings of which:

Figure 1:
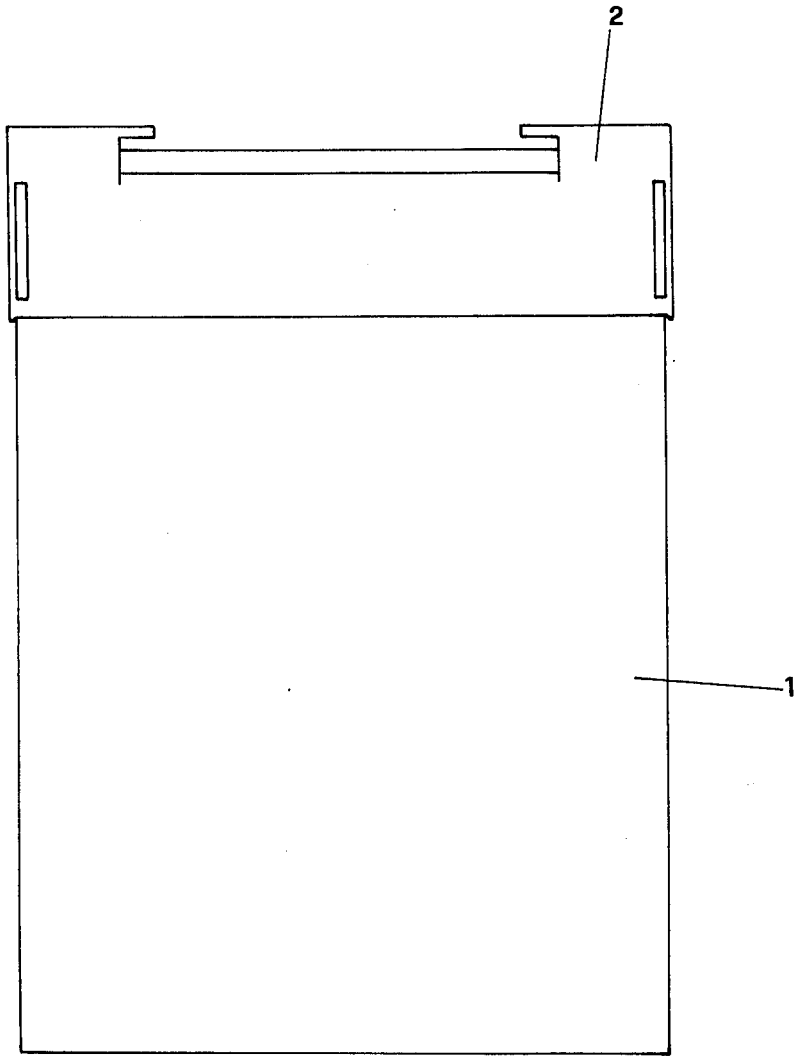
FIG. 1 is the front view of the board according to the present invention.
Figure 2:
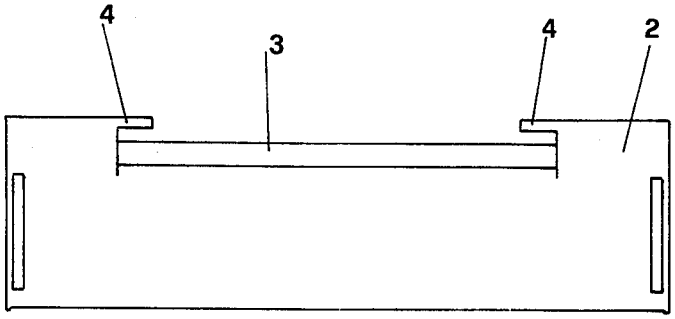
FIGS. 2 and 3 illustrate front view of the header and the board itself.
Figure 3:
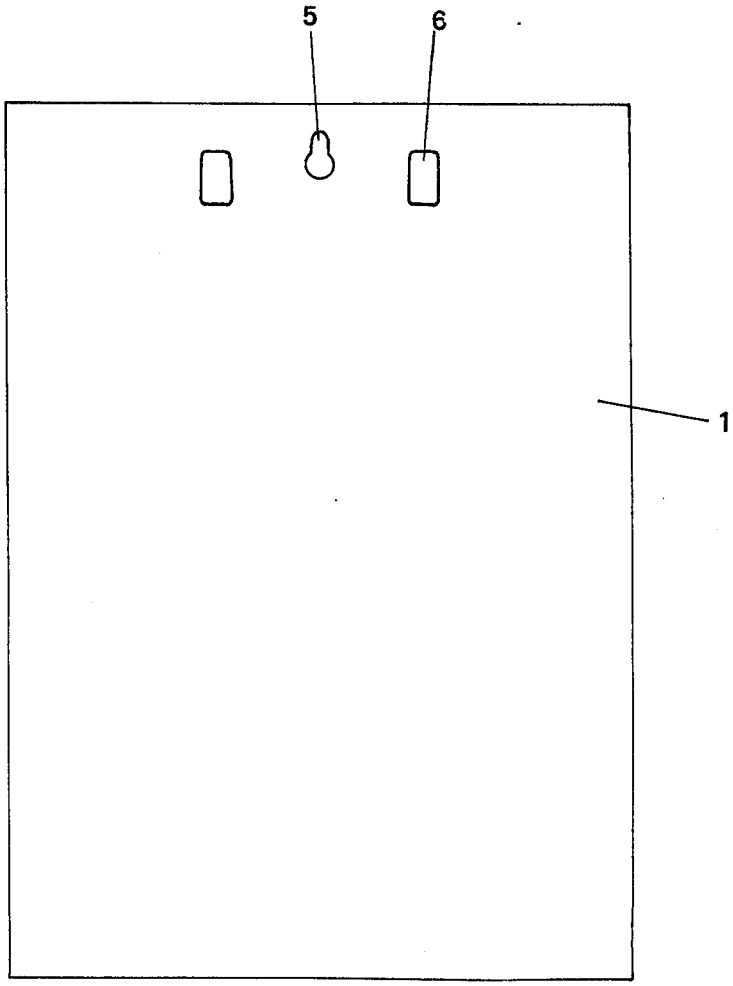

As shown in FIG. 1, the device consists of a board 1 preferably made of cardboard, wood or other flexible material and a header 2 hooked in the upper part of the board. The surface in view of the header may have printed promotional material or advertising material, or the name of the company. On the rear part of the header 2 there is an imprint which has a rear shoulder 3 and in the upper part on the lateral ends of the shoulder, there is a pair of retaining wings 4. The pen being used for writing, of the type well known, may be located in the same imprint. The pen may be filled with a special type of ink for the purpose of obtaining very clear marks on the surface of the board, suitably coated by a film of plastic material for the purpose of erasing easily the marks left by the pen. In this manner, the board may be used an infinite number of times. As shown in FIG. 3 corresponding to the upper part of the board, there is an opening 5 suitably shaped for hanging the entire device to a hook. Further, there are two openings 6. The two openings 6, of essentially rectangular shape, disposed symmetrically with respect to the longitudinal axis of the board, are part of the hooking device between the board and the header.

Figure 4:
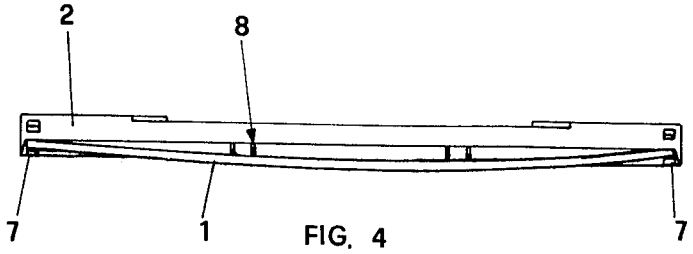
FIG. 4 is a top view of the board in the phase of hooking with the header.
Figure 5:
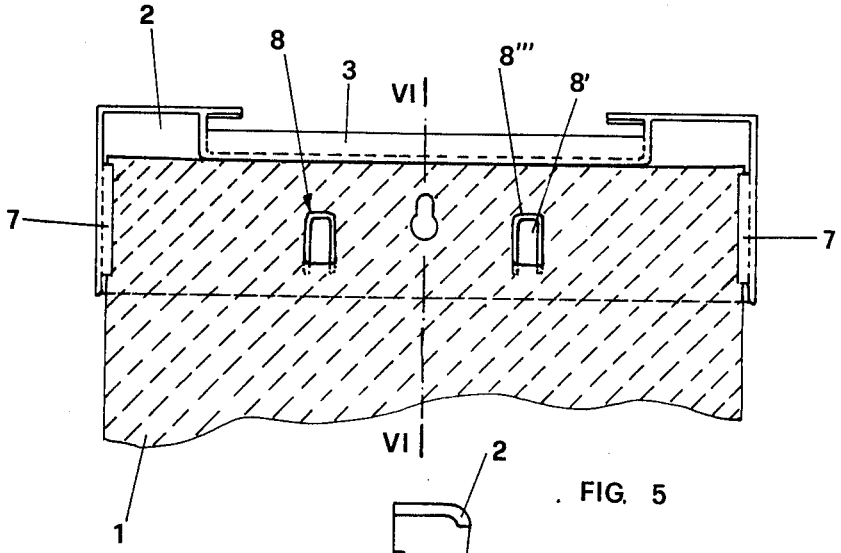
FIG. 5 is a rear view of the header with the board hooked to it.
Figure 6:
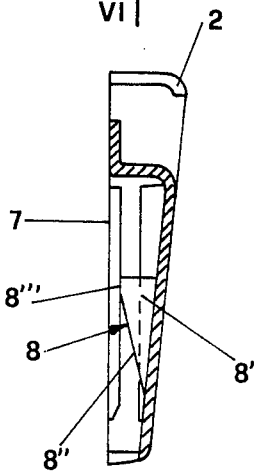
FIG. 6 is a view in cross-section of the header along the line VI—VI of FIG. 5.

As shown in FIGS. 4, 5, and 6, the header has laterally, in the rear part, a pair of wings 7 in the shape of an "L", which have the function of guiding the board, the upper part of which is inserted in the space between the wings and the rear surface of the header.

The two elements 8 are located on the rear of the header. When viewed in front, they assume the typical shape of an inverted "U" as shown in FIG. 5. Each element 8 consists of a pair of planes 8' placed perpendicularly to the header, while the upper border 8'' has a profile in the shape of an inclined plane, as shown in FIG. 6. These planes are joined one to the other by a plane surface 8''' corresponding to the upper terminal part. As shown in FIG. 5, there are two elements 8 placed in a position symmetrical with respect to the longitudinal axis of the device.

Each element 8 is intended to be inserted within one of the openings 6 provided within the board. During the hooking phase, as shown in FIG. 6, one takes advantage of the property of the board being sufficiently elastic so that it may be bent with a concavity turned towards the header. Naturally, after the elements 8 are inserted within the openings 6, the board returns to its perfectly planar shape.

It is clear that the entire header 2 has no portion subjected to forces of bending or other type during the hooking operation, so that there is no possibility that any part of the header will break and the header may be used an infinite number of times. This is particularly useful when both surfaces of the board are intended for writing or for drawings and, for instance, in the case in which one of the surfaces has a square design or it is lined, and the other surface has no design, so that people may use both surfaces.

What is claimed is:

1. A board (1) made of plastic material for writing by means of a pen producing erasable markings, which comprises a header (2) having an imprint (3) wherein the pen is located, said board, in the upper part having a pair of openings (6) of essentially rectangular shape, said openings being located in positions opposite with respect to the longitudinal axis of the board and equidisant therefrom, said header (2) having in the rear surface corresponding to its lateral border a pair of wings (7) "L" shaped, said header having on the rear surface and on the lateral borders thereof two elements (8) constituted by a pair of parallel planes (8') disposed perpendicularly with respect to said header and joined by a planar surface (8''') at the upper end, said planes having an upper board with an inclined profile (8'') whereby said wings (7) during the hooking operation act as a guide for the borders of the upper part of said board (1), said wings going around the board while each of said elements (8) is inserted within one of said openings (6), said hooking operation causing a slight deformation of the upper part of said board and a concavity towards said header, said board returning to a planar shape after the hooking operation is completed.

* * * * *